United States Patent [19]

Pomaro

[11] 3,972,337

[45] Aug. 3, 1976

[54] HAIR CUTTING DEVICE

[76] Inventor: Anthony Cosmo Pomaro, 222 Bay 41 St., Brooklyn, N.Y. 11214

[22] Filed: May 1, 1975

[21] Appl. No.: 573,538

[52] U.S. Cl. ..... 132/45 R

[51] Int. Cl.[2] ..... A45D 24/36

[58] Field of Search ..... 132/45 R, 9, 7; 33/174; 128/348; 30/233.5

[56] References Cited

UNITED STATES PATENTS

| | | | |
|---|---|---|---|
| 1,454,458 | 5/1923 | Smith | 30/233.5 |
| 2,670,744 | 3/1954 | Levin | 132/45 R |
| 2,917,055 | 12/1959 | Fouche | 132/45 |
| 3,241,562 | 3/1966 | Gronier | 132/45 R |

*Primary Examiner*—G. E. McNeill

[57] ABSTRACT

A hair cutting device is disclosed utilizing a pair of scissors, to one leg of which is secured a first end of an elongated post. The opposite end of the elongated post includes a comb-like member which is thereby retained in fixed, spaced relationship to the cutting plane of the scissors. The post may be secured to the scissors by a threaded connection or by a spring clip and may also be made in two sections with a ball joint providing connection therebetween or by an interfitting connection. In addition, the post may be made in telescoping sections that permit the varying of the spacing between the comb-like member and the cutting plane of the scissors. One embodiment of the present invention discloses a comb comprised of a rigid base to which the post is secured and a plurality of relatively closely spaced teeth extending outwardly from the base while another embodiment of the invention provides that the comb-like member includes a plurality of relatively widely spaced, flexible teeth and a base portion to which the post may be secured. In this second embodiment of the comb-like member, the other end of the post may be provided with an integral spring clip that mates with a headed stud that is integral with the scissors.

11 Claims, 6 Drawing Figures

HAIR CUTTING DEVICE

BACKGROUND OF THE INVENTION

1. Field of the Invention

This invention relates generally to hair cutting devices and more particularly to an improved combination of comb and scissors.

2. Description of the Prior Art

Many hair styles that are in vogue today such as shag, frizzette, gatsby look, gypsy, etc. require a substantially uniform length of hair. One other example of such a hair style is called an "afro". It will be appreciated that considerable skill and manual dexterity are required in providing an aesthetically pleasing afro haircut because the major part of the haircut is one predetermined length. Normally, two instruments are used, namely a pair of scissors and a separate comb, which requires the use of both hands by a skilled barber or hair stylist. It will be evident that the quality of the end result depends heavily on the skill and the many years of experience of the operator since two hands and two instruments must be used.

SUMMARY OF THE INVENTION

The present invention overcomes the shortcomings of the prior art by providing a single tool that performs a dual function. In the present invention, a comb-like member is secured to a pair of scissors in fixed spatial relationship to the cutting plane thereof by means of a post. Thus, with the present invention, a hair cut such as an afro can be provided utilizing only a single hand and a single tool. The comb-like member is placed against the individual's head and the scissors are used to cut the hair to a length that is determined by the length of the post that connects the comb-like member to the scissors.

For certain applications, it is desirable that the comb-like member be positioned, at some predetermined angle with respect to the cutting plane of the scissors. In order to provide this function, one embodiment of the present invention includes a post that is made in two sections with a ball joint being used to connect the two sections.

Various other embodiments are disclosed for coupling the post to the scissors. In one embodiment of this invention the post is secured to the scissors by means of mating thread engagement. In another embodiment of this invention, wherein the comb-like member is made of a molded plastic or preformed wire, a spring clip which is integral with the post is used to engage a headed stud that is secured to the scissors.

An alternative embodiment of the present invention discloses interlocking means in a two sectioned post so as to provide simplified disassembly and storage as well as interchangeability of both, the post and comb-like member with different length posts and different comb-like member where desired. In this last mentioned embodiment a first post section is secured to the scissors in any suitable manner at one end thereof, while the other end of the first post section is provided with a transverse groove that is adapted to releasably engage a similarly shaped transverse groove that is formed on the end of the second post section to which the comb-like member is secured.

In still another application of the present invention, means are provided for varying the spacing between the comb-like member and the cutting plane of the scissors. In this last mentioned embodiment the post may be formed in telescoping sections so that the post may be elongated or shortened, as desired.

Accordingly, it is an object of the present invention to provide an improved hair cutting device wherein a comb-like member is maintained in a predetermined, spaced relationship with the cutting plane of a pair scissors.

Another object of the present invention is to provide a rigid post between a pair of scissors and comb-like member so that the comb-like member is maintained in fixed spatial relationship with the cutting plane of the scissors.

Still another object of the present invention is to provide an improved hair cutting device, as described above, wherein the post is removably secured to the scissors by means of mating threads.

A further object of the present invention is to provide an improved hair cutting device, as described above, wherein the post is made in two sections and wherein there is further provided a universal joint for interconnecting the two post sections.

Yet another object of the present invention is to provide an improved hair cutting device, as described above, wherein said post is made in two sections having interfitting means for releasably coupling the two post sections.

An additional object of the present invention is to provide an improved hair cutting device, as described above, wherein the post is made of telescoping sections that permit a variation in the spatial distance between the comb-like member and the cutting plane of the scissors.

An additional object of the present invention is to provide an improved hair cutting device, as described above, wherein the comb-like member and the post are made of a preformed length of a relatively flexible material and wherein means for connecting the post to the scissors comprises a spring clip on the post at the end thereof that is remote from the comb-like member.

These and other objects, features and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the various figures of the drawing, like reference characters designate like parts. In the drawing.

DESCRIPTION OF THE PREFERRED EMBODIMENTS

Figure 1:
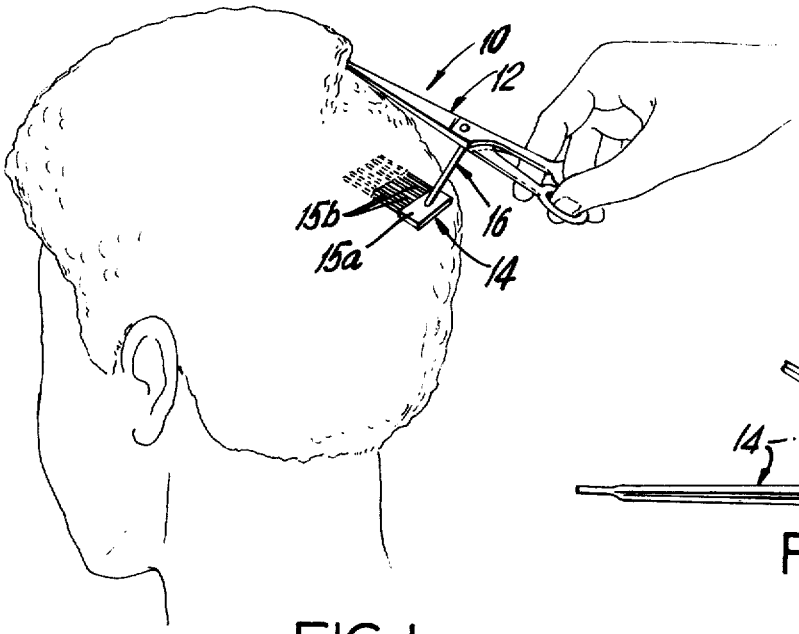
FIG. 1 is a perspective view of one embodiment of the present invention.
Figure 2:
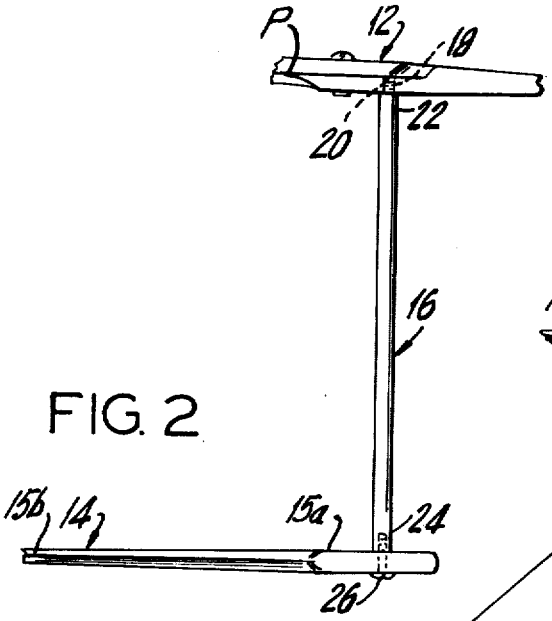
FIG. 2 is a fragmentary, elevational view illustrating the embodiment of the invention shown in FIG. 1.

Referring first to FIGS. 1 and 2 it will be seen that the hair cutting device 10 of the present invention comprises three basic elements which are a pair of scissors 12, a comb-like member 14 and an axially elongated post 16 which is coupled to both the pair of scissors 12 and the comb-like member 14 for the purpose of maintaing a predetermined spatial relationship between the comb-like member 14 and the cutting plane of the pair of scissors 12. As shown in FIG. 1, the comb-like member 14 includes a base portion 15*a* to which the post 16 is secured and a plurality of relatively rigid and relatively closely spaced teeth 15*b* extending outwardly from the base 15*a*.

In a first embodiment of the present invention, as shown for example in FIGS. 1 and 2, one leg of the pair of scissors 12 is provided with female threads 18 which are adapted to threadably engage male threads 20 formed on a first end 22 of the post 16. Alternatively, the screw that pivotally connects the two legs of the scissor may be used for the same purpose and in this event female threads would be formed on the first end 22 of the post 16. It should be understood that this alternative construction may be used with the embodiments that will be described subsequently. A second end 24 of the post 16 is secured to the comb-like member 14 by means of any suitable fastener such as a screw 26. In this manner, the comb-like member 14 is maintained in a fixed, predetermined spatial relationship with the cutting plane P of the pair of scissors 12 with the longitudinal axis of the post 16 being substantially perpendicular to the cutting plane P of the pair of scissors 12.

Figure 3:
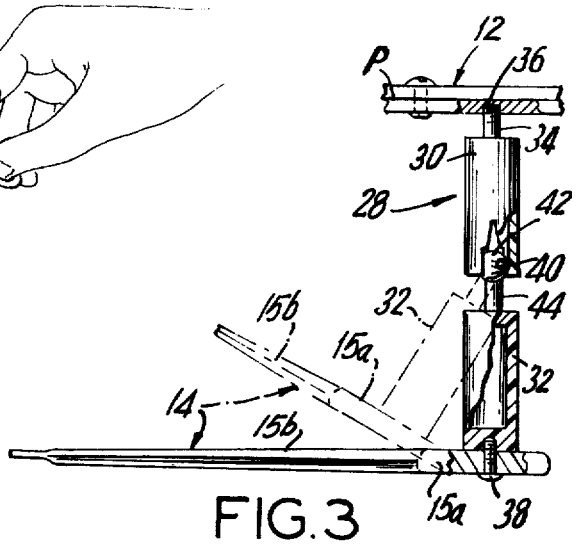
FIG. 3 is a fragmentary, elevational view, partially in section and partially in phantom outline, illustrating an alternative embodiment of the present invention.

An alternative embodiment of the present invention is shown in FIG. 3. In this second embodiment an axially elongated post 28 is made in two sections designated by the reference characters 30 and 32 and which may be solid or tubular. The first post section 30 may be secured to the pair of scissors 12 in any suitable manner such as by means of a threaded post 34 that mates with female threads 36 formed in one leg of the pair of scissors 12. Similarly, the other post section 32 may be secured to the comb-like member 14 by means of a threaded fastener such as a screw 38. In the embodiment of FIG. 3 the two post sections 30 and 32 are coupled to each other by means of a universal joint which may take the form of a socket 40 formed in the first post section 30 and a ball 42 that is secured to the second post section 32 by means of a stem 44. It will be appreciated that by the arrangement shown in FIG. 3 the comb-like member 14 may be positioned at any convenient angle with respect to the cutting plane P of the pair of scissors 12. The frictional fit between the socket 40 and the ball 42 will assure that the comb-like member 14 is maintained in fixed spatial relationship with the cutting plane P of the pair scissors 12.

Figure 4:
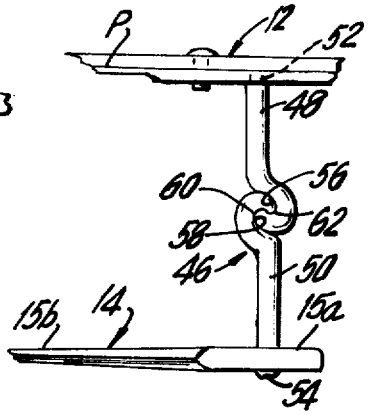
FIG. 4 is a fragmentary, elevational view illustrating another alternative embodiment of the present invention.

The embodiment illustrated in FIG. 4 provides means for rapidly disassembling or separating the comb-like member 14 from the scissors 12. A post 46 is made in two sections which includes an upper section 48 and a lower section 50. The upper post section 48 may be secured to the scissors 12 in any suitable manner, for example, by means of mating threads 52, while the lower post section may be secured to the comb-like member 14 by means of a fastener 54. The end of the upper post section that is remote from the pair of scissors 12 is provided with a transversely oriented groove 56 while the end of the lower post section 50 that is remote from the fastener 54 is similarly provided with a mating, transversely oriented groove 58. The end 60 of the upper post section 48 fits into the groove 58 in the lower post section 50 while the end 62 of the lower post section 50 fits into the groove 56 formed in the upper post section. It will be appreciated that the construction just described provides for rapid disconnection of the two post sections. In addition, the construction shown in the embodiment of FIG. 4 permits for variation in the length of the upper and lower post sections so that the spatial relationship of the cutting plane P of the pair of scissors 12 with respect to the comb-like member 14 may be varied. That is, different lengths of either the upper or the lower post sections may be employed as required. It will be appreciated however, that regardless of the length of any given post section, the spatial relationship between the cutting plane P of the scissors 12 and the comb-like member 14 will remain constant. Further, this embodiment provides for the rapid interchange of different comb-like members 14.

Figure 5:
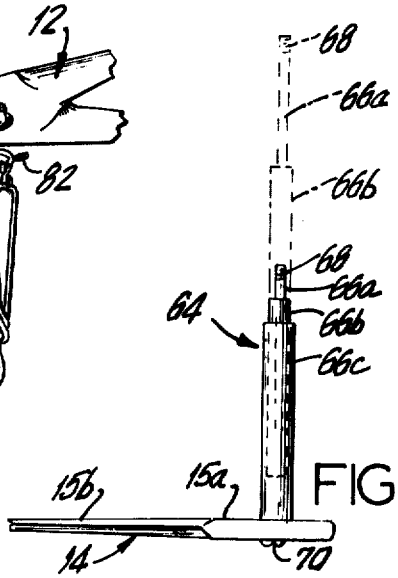
FIG. 5 is a fragmentary, elevational view, partially in phantom outline, illustrating an alternative form of the present invention with the pair of scissors being omitted for clarity.

Another alternative embodiment of the present invention is shown in FIG. 5. A post 64 is made in several sections 66*a*, 66*b*, 66*c*, etc. The end section 66*a* may be in the form of a rod having male threads 68 that are adapted to engage female threads in the pair of scissors (now shown). The opposite end of the post section 66*c*, may be formed with female threads for receiving a fastener 70 so that the post 64 may be secured to the comb-like member 14. It will be appreciated that the telescoping sections 66*a*, 66*b*, and 66*c*, the number of which are shown for purposes of illustration only, permit the length of the post 64 to be varied while still maintaining a fixed spatial relationship between the cutting plane P of the pair of scissors 12 and the comb-like member 14. In a manner well known in the art, a suitable friction fit can be provided between adjacent telescoping sections.

Figure 6:
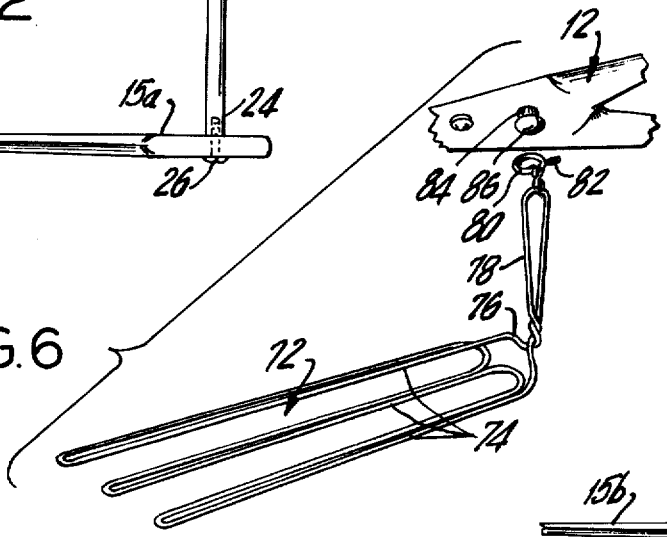
FIG. 6 is a fragmentary, perspective exploded view illustrating still another embodiment of the present invention.

FIG. 6 illustrates still another alternative embodiment of the present invention. In this last mentioned embodiment a comb-like member 72 may be molded from a suitable plastic material or may be formed from a length of wire that is formed so as to define a plurality of relatively widely spaced, flexible teeth 74 and a base 76. A post 78 is also formed of plastic or wire and is either co-molded or otherwise suitably secured at one end thereof to the base 76. The opposite end of the post 78 defines a resilient spring clip 80 which may be opened or closed merely be displacing the free end 82 thereof. The spring clip 80 is adapted to be mounted on a stud 84 that is secured to the pair of scissors 12 in any suitable manner, such as by mating threads. The stud 84 includes an enlarged head 86 over which the spring clip 80 is placed so that the spring clip 80 is positioned about the stud 84 and is retained by the head 86. The embodiment illustrated in FIG. 6 also assures that the comb-like member 72 will be maintained in fixed spatial relationship with the cutting plane P of the pair of scissors 12.

From the foregoing, it will be appreciated that an improved, low cost hair grooming device, has been provided which is relatively simple to use and which may be manipulated by one hand. The present invention provides a single, dual-function tool that maintains a fixed spatical relationship between a comb-like member and a pair of scissors so that the hair may be cut to a uniform length. Means are also disclosed for both varying the angle of the comb-like member with respect to the cutting plane of the scissors and for varying the distance of the comb-like member with respect to the cutting plane of the scissors while, in each instance, maintaining a fixed spatial relationship between the cutting plane of the pair of scissors and the comb-like member.

There have been disclosed heretofore the best embodiments of the invention presently contemplated. However, it is to be understood that various changes and modifications may be made thereto without departing from the spirit of the invention.

What I claim as new and desire to secure by Letters Patent is:

1. A hair cutting device comprising the combination of:

a. a pair of scissors having cooperating cutting edges;
b. axially elongated post means;
c. means for securing one end of said post means to said pair of scissors; and
d. a comb-like member secured to the other end of said post means and positioned in a plane that is spaced from the cutting plane of said pair of scissors, said comb-like member having a plurality of teeth the axes of which are substantially parallel to the cooperating cutting edges of said scissors.

2. The hair cutting device according to claim 1 wherein said post means comprises first and second sections and universal joint means for coupling said first and said second sections to each other, one end of one of said sections being secured to said pair of scissors and one end of said other section being secured to said comb-like member.

3. The hair cutting device according to claim 2 wherein said universal joint comprises a ball on one end of one of said sections and a cooperating socket on the confronting end of said other section.

4. The hair cutting device according to claim 1 wherein said post means comprises first and second sections and interconnecting means on the confronting ends thereof for releasably coupling said first and second sections to each other.

5. The hair cutting device according to claim 1 wherein said post means comprises a plurality of sections that are telescopically fitted one into the other to vary the effective length of said post means.

6. The hair cutting device according to claim 1 wherein said means for securing said post means comprises mating threads on said post means and said pair of scissors.

7. The hair cutting device according to claim 6 wherein said mating threads comprises male threads formed on said post means and female threads formed on said pair of scissors.

8. The hair cutting device according to claim 1 wherein said comb-like member comprises a base to which said post means is secured and a plurality of relatively closely spaced teeth extending outwardly from said base.

9. The hair cutting device according to claim 1 wherein said comb-like member comprises a plurality of relatively widely spaced apart teeth and a base portion at which said post means is located.

10. The hair cutting device according to claim 9 wherein said post means is an extension of said comb-like member, said means for securing said post means to said scissors comprising a resilient clip formed on the end of said post means that is remote from said comb-like member and a headed stud that is integral with said pair of scissors for releasably receiving said spring clip.

11. The hair cutting device according to claim 1 wherein at least a portion of the longitudinal axis of said post means is substantially perpendicular to the cutting plane of the pair of scissors.

* * * * *